United States Patent [19]

LaBianco

[11] 4,057,862

[45] Nov. 15, 1977

[54] WATER BED

[76] Inventor: Richard A. LaBianco, 2071 La France, South Pasadena, Calif. 91030

[21] Appl. No.: 688,961

[22] Filed: May 24, 1976

[51] Int. Cl.[2] ..... A47C 27/08

[52] U.S. Cl. ..... 5/370; 5/335

[58] Field of Search ..... 5/236 R, 335, 365, 370, 5/371

[56] References Cited

U.S. PATENT DOCUMENTS

| | | | |
|---|---|---|---|
| 3,066,323 | 12/1962 | Kinter | 5/335 |
| 3,241,885 | 3/1966 | Deaton | 297/440 |
| 3,585,356 | 6/1971 | Hall | 5/370 |
| 3,742,531 | 7/1973 | Alsbury et al. | 5/370 |
| 3,761,974 | 10/1973 | Kuss | 5/370 |
| 3,840,921 | 10/1974 | LaBianco | 5/349 |

FOREIGN PATENT DOCUMENTS

| | | | |
|---|---|---|---|
| 2,336,905 | 2/1975 | Germany | 5/335 R |

*Primary Examiner*—Paul R. Gilliam
*Assistant Examiner*—Kenneth J. Dorner
*Attorney, Agent, or Firm*—Christie, Parker & Hale

[57] ABSTRACT

A water bed includes a water-filled bladder resting upon a base having a semi-flexible outer framework providing lateral support for the periphery of the bladder. The outer framework is divided into a lower wedge-shaped portion affixed to the base, and a movable wedge-shaped upper portion resting on the lower wedge and hinged to the base along the inside edge of the lower wedge. The periphery of the water-filled bladder rests against an inclined inside supporting surface provided by the upper wedge. The upper wedge pivots away from the lower wedge toward the bladder to allow access to an elongated open space extending around the outer framework between the wedges. A cushioned cover sheet overlies the bladder, and a flexible skirt extends downwardly around the periphery of the cover sheet. The skirt is fitted into the space between the upper and lower wedges. Fastening means on the skirt are releasably attached to corresponding fastening means between the wedges for applying an adjustable tension to the cover sheet which, in turn, controls the characteristics of the fluid support provided by the water-filled bladder. The space between the wedges also provides room for tucking of bedding, and the normal pressure of the water-filled bladder against the upper wedge holds the tucked bedding in place.

52 Claims, 6 Drawing Figures

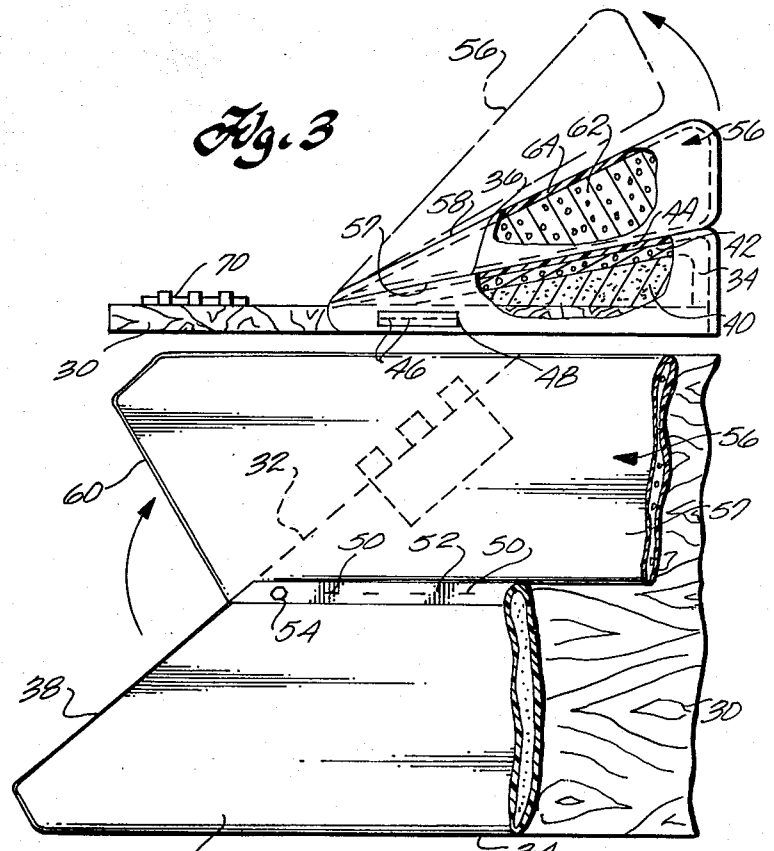
Fig. 3
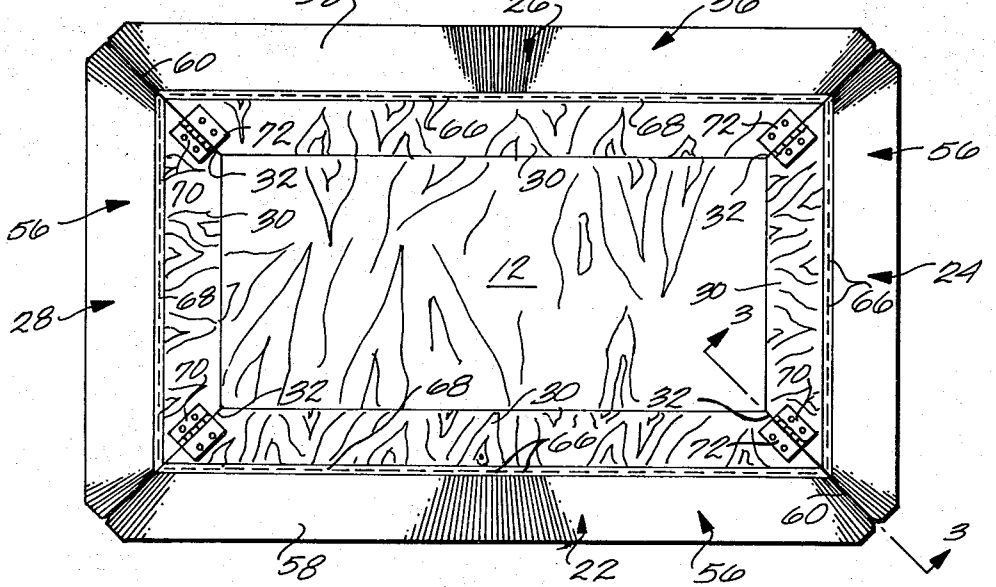
Fig. 4
Fig 2

WATER BED

PRIOR ART

This invention represents an improvement over the water beds disclosed in the following patents:

| U.S. Pat. No. | Patentee |
|---|---|
| 3,585,356 | Hall |
| 3,736,604 | Carson, Jr. |
| 3,742,531 | Alsbury et al |
| 3,840,921 | La Bianco |

BACKGROUND

This invention relates to water beds, and more particularly to an improved framework for supporting the periphery of a water-filled bladder which provides fluid support for the user of the bed.

Previous water beds have had a number of disadvantages which have hindered water beds from breaking into the conventional bed market. One disadvantage of previous water beds is their use of a solid peripheral support frame which completely confines the water-filled bladder. The solid support is discomforting to one sitting on the bedside, and a nuisance to one who climbs in or out of bed.

It is also difficult to make up bedding on a water bed confined by a solid frame. The sheets, blankets and bedspread must be tucked between the heavy water-filled bladder and the rigid frame. Usually the bedding becomes loosened or undone, because the top outer edge of the bladder pulls in from the support frame when pressure is exerted on the bed, thereby releasing the bedding from its support around the bed.

Moreover, standard bedding such as fitted sheets cannot be used easily on conventional water beds because of the confinement of the bladder completely within its support frame.

Another disadvantage of using a conventional water-filled bladder is that the user often experiences uncomfortable bottoming out; the water-filled bladder often is subject to transverse wave action or sloshing which can be a disturbance to the user; and the bladder is subject to pulling in at the edges when the user enters the bed, which is an inherently unstable supporting surface in addition to causing bedclothes to come loose around the bladder.

Further, many water beds of conventional construction are relatively expensive, heavy, cumbersome, and not easy to assemble.

SUMMARY OF THE INVENTION

This invention provides an improved water bed and support structure for the water-filled bladder of a water bed which eliminates the above, as well as other, problems and disadvantages associated with prior art water beds.

Briefly, one embodiment of the invention includes a framework for supporting a water-filled bladder of a water bed comprising a fixed lower support member for extending around the periphery of a water-filled bladder, and an upper support member resting on an upper surface of the lower support member and also extending around the periphery of the bladder. The upper and lower support members provide lateral support for the periphery of the bladder. The upper support member is movable away from the lower support member to provide access to an elongated open space or gap located between the upper and lower support members. The upper support member is movable so that the space is accessible from an outer extremity of the peripheral support so as to provide means for conveniently tucking sheets, bedclothes or the like. Preferably, fluid pressure is exerted on the peripheral support by the water-filled bladder so that sheets, bedclothes or the like tucked into the space between the upper and lower support members are held in place during use of the bed by the pressure of the bladder. Thus, the supporting framework permits the use of standard size fitted sheets and bedclothes, and improves the ability of the bedclothes to stay on the bed during use.

Preferably, the peripheral support is made from a relatively flexible material to provide a supporting framework which is comfortable for the user sitting on the bedside or getting into or out of bed.

In another form of the invention, a cover sheet overlies the water-filled bladder. A flexible skirt is attached to the periphery of the cover sheet and extends to a position overlying at least a portion of the peripheral framework around the water-filled bladder. Cooperating fastening means releasably secure the skirt in a fixed position relative to the peripheral supporting framework to apply an adjustable amount of tension to the cover sheet. This, in turn, provides stability to the top surface of the bladder, which prevents the bladder from pulling in around the edges, prevents bottoming out, and reduces the amount of wave action in the bladder transferred to the user of the bed.

These and other aspects of the invention will be more fully understood by referring to the following detailed description and the accompanying drawings.

DRAWINGS

FIG. 2 is a plan view showing a peripheral framework of the water bed of FIG. 1;

FIG. 3 is an end elevation view, partly broken away and partly in cross-section, taken on line 3—3 of FIG. 2;

FIG. 4 is a fragmentary plan view illustrating the detailed means of construction of the peripheral framework;

DETAILED DESCRIPTION

Figure 1:
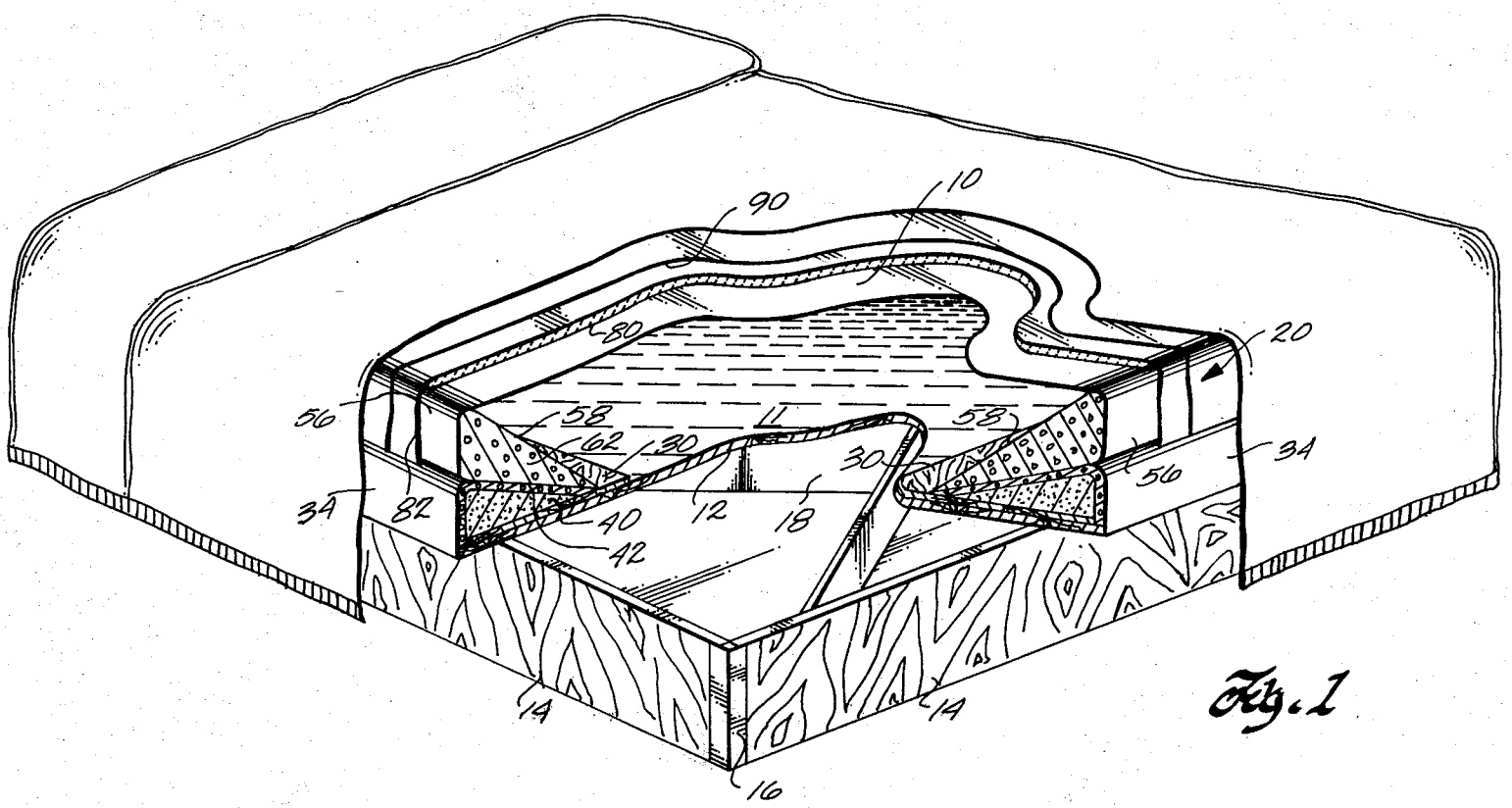
FIG. 1 is a perspective view, partly broken away and partly in cross-section, showing a water bed according to the principles of this invention.
Figure 5:
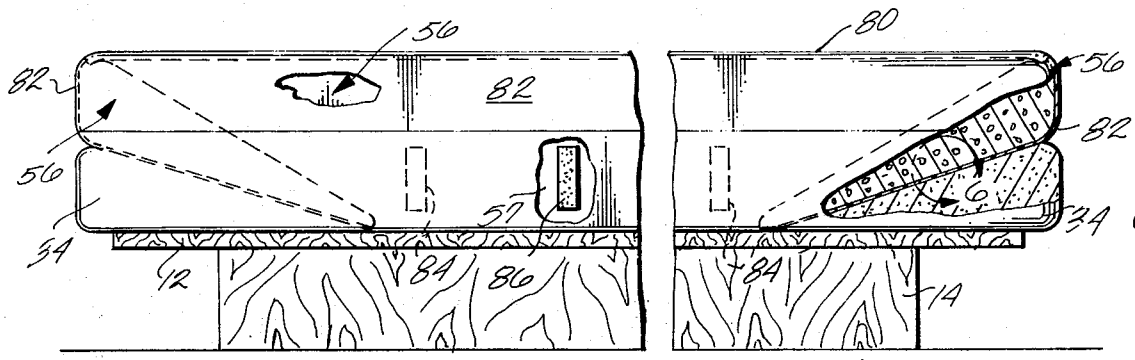
FIG. 5 is a fragmentary elevation view, partly broken away, showing an improved means for adjusting the stability of the fluid support provided by the water bed.
Figure 6:
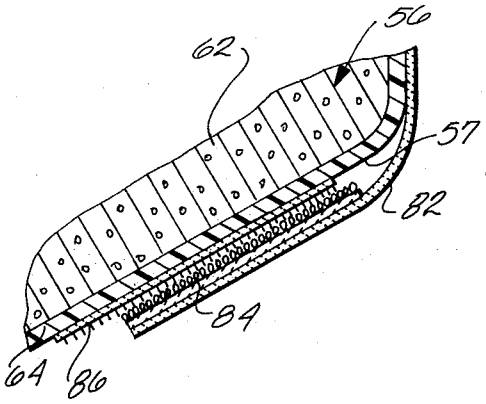
FIG. 6 is an enlarged fragmentary cross-sectional elevation view illustrating the subject matter shown within the circle 6 of FIG. 5.

FIG. 1 shows a water bed which includes a rectangular-shaped bladder 10 filled with a body of water 11. The bladder 10 may be of any sealable and flexible water-tight material, preferably vinyl.

The bottom of the water-filled bladder 10 rests primarily on the top surface of a flat, rigid platform or base 12. Preferably, the platform shown in the drawings is rectangular, although other desired shapes also can be used. The platform 12 also may be a single piece, although it is preferably in several sections.

The platform 12 is supported in a horizontal position at a desired elevation above the floor by a rigid lower supporting structure which includes an upright rectangular frame assembled from elongated panels or riser boards 14, the ends of which are releasably interconnected by corresponding right-angle extrusions 16. The rectangular frame supports a peripheral portion of the platform 12. A number of upright X-shaped supports 18 are formed by several releasably interlocked panels. The X-shaped supports are located within the confines of the rectangular frame to support the central portion of the platform 12.

A peripheral bladder support structure 20 according to the principles of this invention rests on the top surface of the platform 12 and extends around the perimeter of the platform. Since the platform 12 is rectangular, the peripheral support structure 20 also is rectangular, with a separate length of the support structure extending along each edge of the rectangle. The peripheral portion of the water-filled bladder rests on the rectangular support structure 20 to provide lateral support for the water 11 contained in the bladder 10. The bladder support structure 20 includes a lower support member 34 and an upper support member 56 each of which provides a portion of the lateral support for the water 11 contained in the bladder 10. The upper and lower support members will be described in detail below.

The detailed construction of the peripheral support structure 20 is understood best by referring to FIGS. 2 through 4 in conjunction with FIG. 1. The support structure 20 preferably is divided into elongated sections which are releasably attached to one another around the perimeter of the platform 12. In the form illustrated in the drawings, there are four sections 22, 24, 26 and 28, each section for a respective edge of the rectangular platform 12. Each section is substantially identical in construction and includes a base board 30 for extending along an outer extremity of the platform 12. The base boards of the corresonding sections have diagonal ends 32 so that the base boards of the respective sections will join together (as illustrated in FIG. 2) as a rectangular base overlying the outer peripheral portions of the rectangular platform 12.

Each section of the support structure 20 includes a corresponding elongated lower support member 34 which extends from end-to-end along the outer extremity of the base board 30. The lower support member 34 preferably is generally wedge-shaped in transverse cross-section continuously from end to end. As illustrated best in FIG. 3, the lower support member or lower wedge 34 is arranged so that one surface of the wedge rests on an outer peripheral portion of the base board 30, with the short side of the wedge extending essentially vertically above the outer edge of the base board. The angular inclination of the wedge is roughly in the range of 20° to 40°, with an angle of approximately 30° being preferred. This positions an inclined supporting surface 36 of the lower wedge 34 so that it faces inwardly toward the water-filled bladder 10 when all sections 22, 24, 26 and 28 of the peripheral support structure are arranged around the periphery of the platform 12, as illustrated best in FIG. 2. The lower wedge 34 has diagonal ends 38 which are aligned with the diagonal ends 32 of the base board sections 30.

The lower support member 34 is a self-supporting member which is preferably made from a generally triangular core 40 of a rigid material such as polystyrene form blocking. The core 40 rests on the base board 30 and is covered with a layer 42 of resilient material such as high density polyurethane foam, or other relatively deformable material. The core 40 and layer 42 are then covered with an outer layer 44 of any suitable upholstering material such as cloth-covered vinyl. Preferably, the vinyl overlaps the diagonal ends of the base board 30, as well as overlapping the outer edge of the base board. The overlapped portions of the vinyl covering are attached to the edges of the base board by staples 46 extending through corresponding protective sheets 48 such as cardboard. The vinyl along the inside edge of the lower wedge 34 is lapped over the top surface of the base board 30 and attached to the base board 30 along the inside edge of the wedge continuously from one end to the other. Preferably, this portion of the wedge is attached by a row of staples 50 extending through an elongated protective strip of cardboard 52. Fasteners such as screws or bolts 54 also can be used to permanently affix the lower wedge to the base board 30.

Each section of the peripheral support structure 20 also includes a corresponding elongated upper support member 56 which rests on the inclined surface 36 of the lower wedge 34 and extends from end-to-end along the length of the lower wedge. The upper support member 56 preferably is also of generally wedge-shaped transverse cross-section continuously from end-to-end. As illustrated best in FIG. 3, the upper support member or upper wedge 56 is configured and arranged so that a lower surface 57 of the wedge 56 rests on the inclined upper surface 36 of the lower wedge 34, with the short side of the upper wedge 56 extending essentially vertically above the outer edge of the lower wedge. The angular inclination of the upper wedge 56 is roughly in the range of 20° to 40°, so that an inclined upper supporting surface 58 extends above the plane of the platform 12 at an angle in the range of about 55° to 65°, preferably about 60°. This positions the inclined supporting surface 58 of the upper wedge 56 so that it faces inwardly toward the water-filled bladder when all sections 22, 24, 26 and 28 of the peripheral support structures are arranged around the periphery of the platform 12. The upper support member 56 has diagonal ends 60 which are aligned with the diagonal ends 32 and 38 of the base board sections and the lower wedge 34, respectively, when the peripheral support structure is assembled as illustrated in FIG. 2.

The upper support member 56 is a self-supporting member which is preferably is made from a generally wedge-shaped core 62 of resilient material such as high density polyurethane foam, or other relatively defomable material. The corners of the upper and lower wedge foam pieces preferably are blunted to duplicate the rounded corners of conventional mattress design. The entire outer surface of the core 62 is covered with an outer layer 64 of any suitable upholstering material such as cloth-backed vinyl. Preferably, the vinyl along the inside edge of the upper wedge 56 overlaps the top surface of the base board 30 and is attached to the base board by staples 66 extending through a protective strip 68 of cardboard, as shown best in FIG. 2. This construction hinges the upper wedge 56 to the base board 30 continuously along the inside edge of the upper wedge. This allows the upper wedge to pivot away from the fixed lower wedge 34, as illustrated best in FIG. 3. FIG. 4 illustrates the upper wedge 56 pivoted completely away from the lower wedge 34, although in use the upper wedge only needs to be pivoted through a small angle away from the lower wedge, as will become clearer from the description to follow.

The sections of the peripheral support structure 20 are assembled as illustrated best in FIG. 2. The adjoining diagonal edges 32 of the base boards 30 are secured together preferably by engaging cooperating hinges 70 and 72 on opposite portions of the adjoining base boards 30. A separate hinge pin is then inserted through each hinge pair so that the base boards 30 will be secured together as a rigid rectangular frame. The hinges preferably are covered by respective vinyl pieces (not shown). Moreover, the individual base boards 30 may be affixed to the platform 12 by fasteners (not shown).

The bed is then assembled by placing the bladder 10 within the confines of the peripheral support structure 20 upon a suitable safety liner (not shown) and then filling the bladder with water. When the bladder is filled, the top surface of the bladder is at the level generally of the top edge of the upper support member 56. In this way, the peripheral portion of the water-filled bladder rests against the inclined surface 58 of the upper support member 56 to provide support for the water in the bladder.

After the bladder is filled, a cover sheet 80 according to this invention is placed over the top surface of the bladder. The cover sheet covers substantially the entire area of the bladder top surface. The cover sheet 80 can be of various flexible materials, but preferably it is a double layer fabric material having a cushioned interior of polyester fabric or the like. The cover sheet 80 rests on the top surface of the bladder and is not attached to the bladder itself. Moreover, the cover sheet lies essentially in the same plane as the top edges of the upper wedges 56, or at least above the top edges.

A flexible skirt 82 of fabric material spans the outer perimeter of the cover sheet 80. The skirt 82 extends down alongside the outer upright edges of the peripheral double-wedge bladder supporting structure 20. The flexible skirt 82 has fastening means attached to it for use in attaching the skirt in a fixed position relative to the peripheral support structure 20. Preferably, the fastening means on the skirt are spaced-apart elongated strips 84 of a first type of thistle-cloth material, preferably that sold under the trademark Velcro. The fastening strips 84 preferably are attached to the inside surface of the skirt 82 so their extent is generally perpendicular to the peripheral edge of the cover sheet 80. Spaced-apart strips 86 of a cooperating second type of Velcro material are attached in corresponding locations on the lower surface 57 of the upper wedge 56. Preferably, three or more of the fastening strips 84 are attached along each of the four lengths of the skirt 82, and a like number of the fastening strips 86 are attached in corresponding locations along the bottom surface 57 of each upper wedge 56. However, the means of attachment to fasteners on the skirt can be in other locations on the water bed framework such as on the lower wedge 34, or on the platform 12.

In using the cover sheet 80 and skirt 82, the upper wedges 56 are pivoted upwardly away from the lower wedges 34 by a sufficient amount to allow the skirt to be tucked into the open space formed between the wedges when each upper wedge is moved away. The skirt 82 is tucked around the entire perimeter of the bed and the fastener strips on the slirt are then secured to those on the bottom surface of the upper wedge to hold the cover sheet 80 and skirt firmly in place. The fastener strips are sufficiently long and are arranged so that the skirt can be attached to different selected locations on the upper wedge to provide a means for adjusting the tension or pull on the cover sheet once the skirt is attached and the upper wedge 56 is moved back to its normal position resting on the top of the lower wedge 34. Thus, the cover sheet 80 can be in a relatively loose or relaxed condition on the water-filled bladder, or it can be secured in a relatively taut condition. This allows the user to selectively adjust the firmness of the sleeping support provided by the bed. For example, as the cover sheet 80 is pulled relatively taut, it increases the stability of the top surface of the water-filled bladder and can make the bladder relatively free from pulling in at the edges when the user enters or leaves the bed. It can also reduce the level of the transverse wave action in the bed, as well as prevent uncomfortable bottoming out.

once the cover sheet and skirt are in place, and the tension in the cover sheet is adjusted, bedclothes such as a fitted sheet 90 then can be placed on the bed. This is accomplished by raising each upper wedge 56 away from its corresponding lower wedge 34, and then tucking the sheet into the open space formed between the upper and lower wedges. Fitted sheets are especially simple to place on the bed because the corners of the upper wedges 56 can be moved to an elevated position which makes it relatively easy to slip the corners of the fitted sheet over the corners of the upper wedges. Once the sheet and the rest of the bedclothes are tucked between the upper and lower wedges, the pressure exerted on the wedges by the water-filled bladder resists any tendency of the bedclothes to be pulled out from their tucked position around the bed.

Thus, the present invention provides a peripheral supporting framework which is relatively flexible so that it provides more comfort for the user entering or leaving the bed or sitting on the bedside. The movable upper wedge makes it relatively easy to apply the bedding around the peripheral framework, and the pressure of the water against the upper wedge holds the bedding in its tucked position. Tucking of bedding around the peripheral support is preferred to abusing seams at the ends of the water-filled bladder when tucking bedding around the bladder of a conventional water bed. The upper wedge takes advantage of the natural strength of cloth-backed upholstery vinyl to form reliable hinges for the movable wedge. The invention also provides means for selectively adjusting the firmness of the sleeping support provided by the bed. Further, the modular structure of the framework results in relatively lightweight components which are easily assembled.

I claim:

1. A framework for confining a water-filled bladder of a water bed, the framework comprising an elevated means of lateral support for extending around the periphery of the water-filled bladder to provide lateral support for the periphery of the bladder, the lateral support means having a fixed lower support member and an upper support member resting on a surface of the lower support member, and means hinging an inner portion of the upper support member to enable the upper support member to pivot away from said surface of the lower support member to increase the size of an elongated space located between the upper and lower support members to provide means for receiving bedclothes overlying the water-filled bladder.

2. The framework according to claim 1 in which the upper support member is generally wedge-shaped in transverse cross-section, has an outer edge which extends upwardly more than its inner edge, and the hinge means enables the upper support member to pivot about its inner edge.

3. The framework according to claim 2 in which the lower support member, in transverse cross-section, has an outer edge which extends upwardly more than its inner edge, and the upper support member overlies the lower support member so they cooperate to form said elevated lateral support means having an outer extremity which is elevated more than its inner extremity.

4. The framework according to claim 1 in which the upper support member is made from a deformable material.

5. The framework according to claim 1 including a rigid base, and in which the lower support member is rigidly affixed to the base, and the upper and lower support members extend around a confined area of the base to provide said lateral support means for the water-filled bladder.

6. The framework according to claim 5 in which the portion of the base confined by the lateral support means provides means to support the bottom portion of the water-filled bladder.

7. The framework according to claim 5 in which the upper support member, in transverse cross-section, has an outer edge which extends upwardly more than its inner edge, and the hinge means enables the upper support member to pivot about its inner edge.

8. The framework according to claim 7 in which the upper support member, when resting on the lower support member, provides an upwardly and outwardly inclined upper surface of the lateral support means for contacting the peripheral portion of the water-filled bladder.

9. The framework according to claim 5 in which the hinge means pivotally secures an elongated inner edge of the upper support member to the base.

10. The framework according to claim 5 in which the upper support member has an elongated lower inside edge which extends around the area confined by the lateral support means, and the lower inside edge of the upper support member is hinged to enable the upper support member to pivot away from the lower support member toward the area confined within the peripheral support.

11. The framework according to claim 1 in which the upper support member is hinged along its furthest inward extent.

12. The framework according to claim 11 in which the upper support member is hinged along its lowest extent.

13. The framework according to claim 11 in which the upper support member is hinged to pivot angularly away from the lower support member so that the wider portion of said elongated space extends along the outermost peripheral extent of the lateral support means.

14. The framework according to claim 1 in which the upper and lower support members each have elevated outer peripheral edges, and in which access to said elongated space is located along the juncture of said outer peripheral edges.

15. The framework according to claim 1 in which the upper and lower support members comprise self-supporting members each of which provides a portion of the lateral support for the water-filled bladder.

16. A water bed comprising:

a. a rigid base, b. a water-filled bladder resting on the base, c. an elevated means of lateral support resting on the base and extending around an area of the base to provide lateral support for a peripheral portion of the bladder, d. the means of lateral support comprising an elongated lower support member affixed to the base, and an elongated upper support member resting on a surface of the lower support member, and e. means hinging an inner portion of the upper support member to enable the upper support member to pivot away from the surface of the lower support member to increase the size of an open space located between the upper and lower support members to provide means for receiving bedclothes overlying the water-filled bladder.

17. A water bed according to claim 16 in which each support member is made from a deformable material, and the upper support member is more deformable than the lower support member.

18. A water bed according to claim 16 in which said upper support member is hinged along its furthest inward extent.

19. A water bed according to claim 18 in which said upper support member is hinged along its lowest extent.

20. A water bed according to claim 18 in which the upper support member is hinged to pivot angularly away from the lower support member so that the wider portion of the open space extends along the outermost peripheral extent of the lateral support means.

21. A water bed accordingly to claim 16 in which the upper support member, in transverse cross-section, has an outer edge which extends upwardly more than its inner edge, and the hinge means enables the upper support member to pivot about its inner edge.

22. A water bed according to claim 21 in which the lower support member, in transverse cross-section, also has an outer edge which extends upwardly more than its inner edge, and in which the upper support member overlies the lower support member so that they cooperate to form said lateral support means having an outer extremity which is elevated more than its inner extremity.

23. A water bed according to claim 16 in which the upper and lower support members each provides a portion of said lateral support for the water-filled bladder.

24. In a water bed having a water-filled bladder and a peripheral support means for providing lateral support for a peripheral portion of the bladder, the improvement wherein the peripheral support means includes an upper portion which is movable relative to a fixed lower portion thereof to provide an open space between the upper and lower portions extending around the peripheral support, and further including a cover sheet overlying a top surface of the water-filled bladder, a flexible skirt attached to the periphery of the cover sheet and extending away therefrom and overlying at least a portion of the peripheral support means, the skirt being extendable into said open space, and cooperating fastening means for releasably securing the skirt in a fixed position relative to the peripheral support to apply an adjustable amount of tension to the cover sheet, the releasable fastening means being located in said open space for being releasably attached to ccorresponding fastening means on the skirt.

25. The improvement according to claim 24 including fastening means spaced apart around the periphery of the skirt, and cooperating fastening means spaced apart around the peripheral support means.

26. The improvement according to claim 25 including means for attaching each of the cooperating fastening means to different locations relative to one another to provide said means for adjusting the tension in the cover sheet.

27. The improvement according to claim 26 in which the cooperating fastening means comprise cooperating elongated strips of thistle-cloth material.

28. The improvement according to claim 24 in which the fastening means are spaced apart around the periphery of the skirt and cooperating fastening means are spaced apart around the portion of the peripheral support within the open space.

29. The improvement according to claim 28 including means for attaching each of the cooperating fasteners to different locations relative to one another to provide said means for adjusting tension in the cover sheet.

30. The improvement according to claim 29 in which the cooperating fastening means comprise cooperating elongated strips of thistle-cloth material.

31. The improvement according to claim 30 in which the cover sheet comprises a cushion material simulating a mattress.

32. A framework for confining a water-filled bladder of a water bed, the framework comprising a fixed lower support member for being arranged to extend around the periphery of a water-filled bladder; and an upper support member resting on an upper surface of the lower support member to extend around said periphery; the upper and lower support members providing lateral support means for the periphery of said water-filled bladder; the upper support member being movable away from said upper surface of the lower support member to increase access to an elongated spaced located between the upper and lower support members, the upper support member being so movable that said space is accessible from an outer extremity of said lateral support means; the upper support member being generally wedge-shaped in transverse cross-section, and being arranged to pivot about an elongated inner edge of the wedge-shaped member, the lower support member also being generally wedge-shaped in transverse cross-section, with the upper support member overlying the lower member so they cooperate to form an elongated generally wedgeshaped lateral support means.

33. A framework for confining a water-filled bladder of a water bed, the framework comprising a fixed lower support member for being arranged to extend around the periphery of a water-filled bladder; and upper support member resting on an upper surface of the lower support member to extend around said periphery; a rigid base, the lower support member being rigidly affixed to the base; the upper and lower support members extending around a confined area of the base to provide a means of lateral support for the periphery of the water-filled bladder; the upper support member being movable away from said upper surface of the lower support member to increase access to an elongated space located between the upper and lower support members, the upper support member being so movable that said space is accessible from an outer extremity of said lateral support means; the base having a plurality of sections, and in which a corresponding set of said upper and lower support members is affixed to each section; and means for releasably attaching the sections together so the support members of the attached sections cooperate to form said peripheral support, the upper support member in each set being movable relative to those in the other sets.

34. The framework according to claim 33 in which each section is generally elongated and forms one side of a rectangular peripheral support.

35. A water bed comprising:

a. a rigid base, b. a water-filled bladder resting on the base, c. a peripheral support resting on the base and extending around an area of the base and having an elevated supporting surface to provide lateral support for a peripheral portion of the bladder, d. the peripheral support comprising an elongated lower support member affixed to the base, and an elongated upper support member resting on an upper surface of the lower support member, and e. means for moving the upper support member away from the upper surface of the lower support member to provide an elongated open space between the upper and lower support members, f. the upper support member being movable so that said open space is accessible along a generally upright outer edge of the peripheral support formed by cooperating portions of the upper and lower support members, the elongated open space opening out through said upright outer edge.

36. A water bed according to claim 35 in which the elongated open space extends around substantially the entire outer perimeter of the peripheral support.

37. A water bed comprising:

a. a rigid base, b. a water-filled bladder resting on the base, c. a peripheral support resting on the base and extending around an area of the base and having an elevated supporting surface to provide lateral support for a peripheral portion of the bladder, d. the peripheral support comprising an elongated lower support member affixed to the base, and an elongated upper support member resting on an upper surface of the lower support member, the upper support member, in transverse cross-section, being generally wedge-shaped, and e. means for moving the upper support member away from the upper surface of the lower support member to provide an elongated open space between the upper and lower support members; the wedge-shaped upper support member pivoting about a lower corner thereof, f. the upper support member being movable so that said open space is accessible from an outer extremity of the peripheral support remote from said supporting surface.

38. A water bed according to claim 37 including means for pivotally attaching said lower edge of the upper support member to the base.

39. A water bed according to claim 37 in which the lower support member, in transverse cross-section, also is generally wedge-shaped, and the support members overlie one another and cooperate to form a generally wedge-shaped peripheral support in which said supporting surface is inclined upwardly and outwardly from the plane of the base.

40. A water bed according to claim 37 in which the base has a plurality of sections, and a corresponding set of said upper and lower support members is affixed to each section; and including means for releasably attaching the sections together so that the support members of the attached sections cooperate to form said peripheral support, the upper support members of each set being movable relative to those in the other sets.

41. A water bed according to claim 40 in which each section is generally elongated to form one edge of a generally rectangular peripheral support.

42. A water bed comprising:

a. a rigid base, b. a water-filled bladder resting on the base, c. a peripheral support resting on the base and extending around an area of the base and having an elevated supporting surface to provide lateral support for a peripheral portion of the bladder, d. the peripheral support comprising an elongated lower support member affixed to the base, and an elongated upper support member resting on an upper surface of the lower support member, e. means for moving the upper support member away from the upper surface of the lower support member to provide an elongated open space between the upper and lower support members, f. the upper support member being movvable so that said open space is accesible from an outer extremity of the peripheral support remote from said supporting surface, g. a cover sheet overlying a top surface of the supported water-filled bladder, h. a flexible skirt spanning the periphery of the cover sheet and extending downwardly into the open space around the peripheral support, and i. means for releasably attaching the skirt in a fixed position within the open space.

43. A water bed according to claim 42 including means for adjusting the point of attachment of the skirt within the open space to adjust the tension in the cover sheet overlying the bladder.

44. A water bed according to claim 43 in which the attachment means comprises an elongated fastener made from a first type of thistle-cloth material attached to a portion of the peripheral support within the open space, and an elongated fastener made from a second type of thistle-cloth material attached to a corresponding portion of the skirt.

45. A water bed according to claim 44 in which the first fastener is attached to a portion of the movable upper support member, and the second fastener is attached to a corresponding inside portion of the skirt.

46. A water bed according to claim 44 in which a series of said first fasteners are spaced apart around the perimeter of the peripheral support, and a series of said second fasteners are spaced apart at corresponding locations around the skirt.

47. A water bed according to claim 42 in which the cover sheet is cushioned to simulate a mattress.

48. A framework for confining a water-filled bladder of a water bed, the framework comprising an elevated means of lateral support for extending around the periphery of the water-filled bladder to provide lateral support for the periphery of the bladder; means forming an elongated gap in the lateral support means to separate the lateral support means into a first support member and a second support member, in which the second support member overlies the first support member; and means hinging an inner portion of the second support member to enable it to pivot away from the first support member to widen the gap to provide means for receiving bedclothes overlying the water-filled bladder.

49. The framework according to claim 48 in which the first and second lateral support members comprise self-supporting members each of which provides a portion of the lateral support for the water-filled bladder.

50. The framework according to claim 49 in which the first support member is hinged alongg its furthest inward extent and along its lowest extent.

51. The framework according to claim 48 in which access to the gap is located along the outermost peripheral extent of the lateral support means.

52. The framework according to claim 51 in which each support member is generally wedge-shaped.

* * * * *

UNITED STATES PATENT AND TRADEMARK OFFICE

CERTIFICATE OF CORRECTION

PATENT NO. : 4,057,862

DATED : November 15, 1977

INVENTOR(S) : RICHARD A. LaBIANCO

It is certified that error appears in the above-identified patent and that said Letters Patent are hereby corrected as shown below:

Col. 4, line 47, delete "is" (second occurrence);
line 49, "defoma-" should read -- deforma- --.
Col. 5, line 20, after "provide" insert -- lateral --;
line 26, after "be" insert -- made --;
line 63, "slirt" should read -- skirt --.
Col. 9, line 22, "cushion" should read -- cushioned --.
Col. 11, line 21, "movvable" should read -- movable --.
Col. 12, line 33, "alongg" should read -- along --.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*